US006540016B1

(12) United States Patent
Baldantoni

(10) Patent No.: US 6,540,016 B1
(45) Date of Patent: Apr. 1, 2003

(54) METHOD OF FORMING HEAT EXCHANGER TUBE PORTS AND MANIFOLD THEREFOR

(75) Inventor: Antonio Baldantoni, Ann Arbor, MI (US)

(73) Assignee: Norsk Hydro, Oslo (NO)

( * ) Notice: Subject to any disclaimer, the term of this patent is extended or adjusted under 35 U.S.C. 154(b) by 0 days.

(21) Appl. No.: 09/683,899

(22) Filed: Feb. 28, 2002

(51) Int. Cl.[7] ..... F28F 9/02
(52) U.S. Cl. ..... 165/173; 29/890.052; 165/176
(58) Field of Search ..... 165/173, 176; 29/890.052

(56) References Cited

U.S. PATENT DOCUMENTS 4,615,385 A * 10/1986 Saperstein et al. ..... 165/173
5,152,339 A * 10/1992 Calleson ..... 165/173
5,243,842 A * 9/1993 Kobayashi et al. .... 29/890.052
5,329,990 A * 7/1994 Chigira ..... 165/173
5,402,571 A * 4/1995 Hosoya et al. ..... 29/890.052

FOREIGN PATENT DOCUMENTS

JP 402309196 A * 12/1990 ..... 165/173

* cited by examiner

*Primary Examiner*—Henry Bennett
*Assistant Examiner*—Terrell McKinnon
(74) *Attorney, Agent, or Firm*—Gary M. Hartman; Domenica N. S. Hartman; Hartman & Hartman, P.C.

(57) ABSTRACT

A heat exchanger manifold (10) and method of forming a tube port (50) on the manifold (10). The manifold (10) comprises first and second walls (12,14) that define an internal passage (18) and an outer cross-sectional shape of the manifold (10). The first wall (12) of the manifold (10) has a concave outer surface in which the tube port (50) of the manifold (10) is to be formed, while the second wall (14) has a convex outer surface. The tube port (50) is formed in the concave first wall (12), such as by piercing. The shapes of the first and second walls (12,14) promote the ability of the manifold (10) to resist deformation when forming the tube port (50) in the first wall (12).

29 Claims, 2 Drawing Sheets

METHOD OF FORMING HEAT EXCHANGER TUBE PORTS AND MANIFOLD THEREFOR

BACKGROUND OF INVENTION

1. Field of the Invention

The present invention generally relates to heat exchangers, such as those of the type used in air-conditioning systems. More particularly, this invention relates to a manifold configuration that is resistant to deformation during a piercing operation to form holes or slots in which cooling tubes can be inserted.

2. Description of the Related Art

Heat exchangers are employed within the automotive industry as condensers and evaporators for use in air conditioning systems, radiators for cooling engine coolant, and heater cores for internal climate control. In order to efficiently maximize the amount of surface area available for transferring heat between the environment and a fluid flowing through the heat exchanger, heat exchanger designs are typically of a tube-and-fin type in which numerous tubes thermally communicate with high surface area fins. The fins enhance the ability of the heat exchanger to transfer heat from the fluid to the environment, or vice versa. For example, heat exchangers used in the automotive industry as air conditioner condensers serve to condense a vaporized refrigerant by transferring heat from the refrigerant to the air forced over the external surfaces of the condenser.

One type of heat exchanger used in the automotive industry is constructed of a number of parallel tubes that are joined to and between a pair of manifolds, creating a parallel flow arrangement. Internal passages within the manifolds define reservoirs that are in fluidic communication with the tubes through tube ports, e.g., holes or slots, formed in the manifolds. One or both manifolds include one or more inlet and outlet ports through which a coolant enters and exits the heat exchanger. Conventionally, such heat exchangers have been constructed by soldering or brazing the tubes to their respective ports. Finally, fins are provided in the form of panels having apertures through which the tubes are inserted, or in the form of centers that can be positioned between adjacent pairs of oblong or flat tubes.

The process by which tube ports are formed has often entailed a significant number of processing steps in order to accurately shape the ports, such that minimal material is employed to achieve a sufficiently strong joint for the intended application. One type of tube port known in the prior art consists essentially of an opening in the manifold wall, as shown in U.S. Pat. No. 5,622,220 to Park et al. While forming such openings generally involves a single punching operation, a drawback of this port configuration is the minimal amount of material available to engage and bond with a tube assembled with the port. In addition, a mandrel or other tooling must typically be used to support the inner diameter of the manifold, and the slug produced by the punching operation must be collected and discarded. These requirements undesirably add complexity and cost to the forming equipment.

A second type of tube port configuration employed in the prior art includes a riser or collar that provides a substantially greater amount of material for engagement with the tube. Risers that protrude outward from a manifold are more difficult to form than a simple opening in a manifold, and have conventionally entailed multiple forming operations. An example of an improved process for forming risers is disclosed in commonly-assigned U.S. Pat. No. 4,663,812 to Clausen. Clausen's process involves forming a projection on a manifold that is then further formed or machined to create a solid riser, which subsequently undergoes a reverse impact extrusion process to form a tubular riser. Collars that protrude into the internal passage of a manifold can be formed by piercing operations that are typically less complicated than processes required to form risers. However, piercing operations can collapse a manifold unless the internal passage of the manifold is adequately supported with a mandrel or other suitable tooling. Another complication encountered when attempting to pierce a tube port in a manifold is the tendency for the manifold to rotate as a result of any asymmetric forces applied by the piercing operation, necessitating the use of appropriate fixturing to secure the manifold.

In view of the above, there is a desire to simplify the process for forming a tube port in heat exchanger manifold. Such an improved process would preferably avoid collapsing of the manifold and minimize the number of steps necessary to form the port, yet consistently yield a port that promotes the joint strength of the tube-port assembly.

SUMMARY OF INVENTION

The present invention provides a method for forming tube ports on a heat exchanger manifold, and a manifold for use in such a method. The invention is particularly suitable for manifolds having an internal passage and an outer cross-sectional shape that are substantially uniform along a length of the manifold, such that the manifold can be formed by extrusion or seam welding.

According to the invention, the manifold comprises first and second walls that define the internal passage and the outer cross-sectional shape of the manifold. The first wall of the manifold has a concave outer surface in which the tube ports of the manifold are formed, while the second wall has a convex outer surface. The concave and convex outer surfaces of the first and second walls, respectively, cause the outer cross-sectional shape of the manifold to be crescent-shaped. The method of this invention generally includes forming the manifold to have the first and second walls as described above, and then forming the tube ports in the first wall, preferably by piercing. According to the invention, a manifold having a crescent-shaped cross-sectional shape is able to resist deformation while a piercing, punching, or other hole-forming operation is performed on the concave surface of the first wall, even if the internal passage of the manifold is not supported. Instead, piercing and other hole-forming operations performed on the concave surface result in moderate stretching of the first wall in the vicinity of the location where piercing takes place.

From the above, it can be seen that the cross-sectional shape of manifolds formed in accordance with this invention allows for tube ports to be formed by a simplified process that requires a minimal number of processing steps, substantially all of which can be performed while the manifold is supported within a single die cavity or other suitable fixturing. An additional advantage of the crescent-shaped manifold of this invention is that the opposite extremities of the manifold provide locations at which the manifold can be clamped to prevent rotation of the manifold in the die cavity, leading to improved dimensional uniformity and consistency of tube ports on a manifold. If a piercing operation is used, tube ports formed by the method of this invention may include a collar that increases the amount of material available to engage and bond to a heat exchanger tube, thereby promoting the joint strength between the port and the tube. Another advantage of the invention is that the configuration of the manifold allows for the use of piercing processes in a wider range of product designs.

Other objects and advantages of this invention will be better appreciated from the following detailed description.

DETAILED DESCRIPTION

Figure 1:
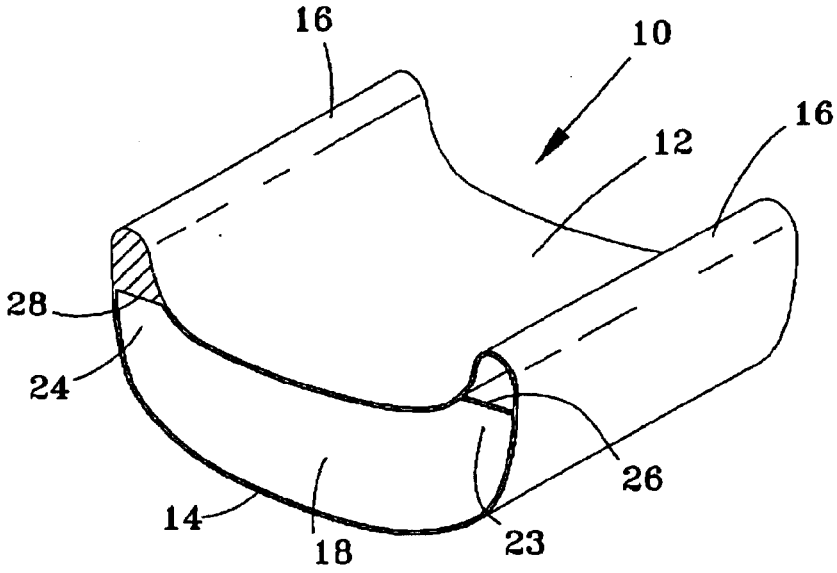
FIG. 1 is a perspective end view of a manifold in accordance with a preferred embodiment of this invention.

A manifold 10 configured in accordance with this invention is represented in FIG. 1 as having a crescent-shaped outer cross-sectional shape. The manifold 10 is preferably formed from a suitable aluminum alloy, though other alloys could be used, and the scope of this invention is not to be limited to any particular alloy.

Furthermore, though the manifold 10 is depicted as being an extrusion, it is foreseeable that the manifold 10 could have a welded seam construction.

Figure 4:
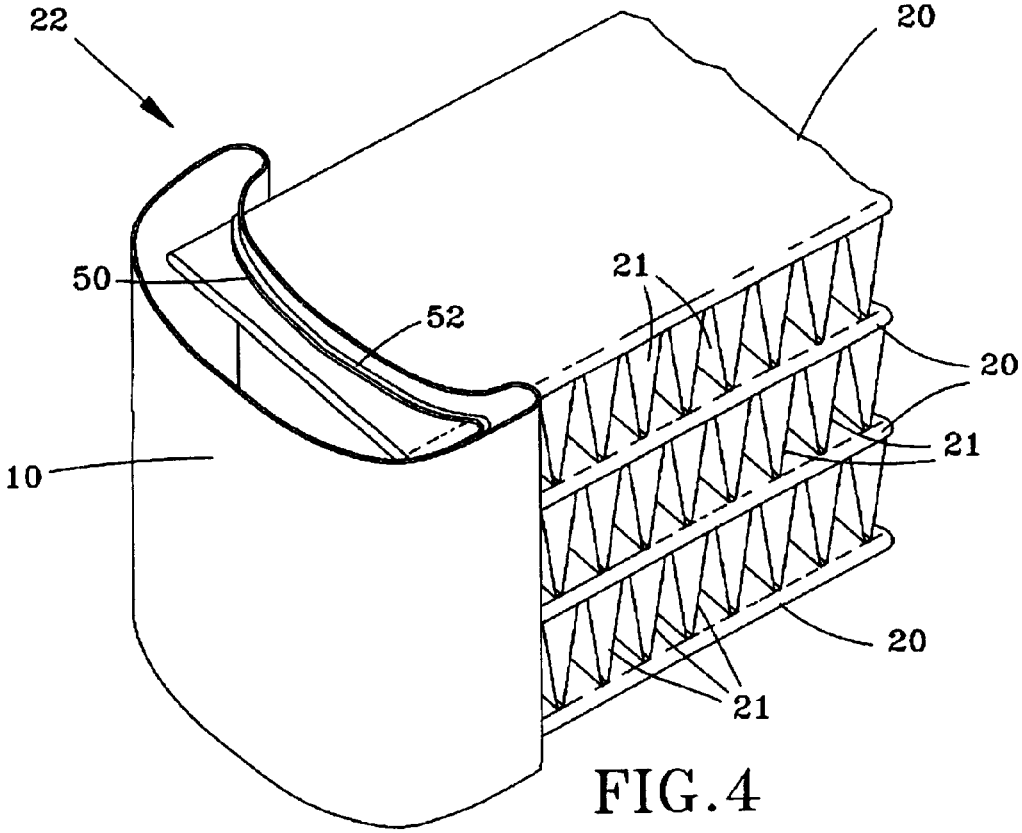
FIG. 4 represents a portion of a heat exchanger comprising the manifold of FIG. 1 assembled with a cooling tubes.

The crescent shape of the manifold 10 is defined by a pair of concave and convex walls 12 and 14, which intersect at oppositely-disposed extremities 16 of the manifold 10. The walls 12 and 14 also define an internal passage 18 within the manifold 10 through which a suitable heat exchange fluid would flow when the manifold 10 is assembled with tubes 20 to form a heat exchanger 22, as shown in FIG. 4. As an extrusion or welded seam construction, the internal passage 18 and the outer cross-sectional shape of the manifold 10 are substantially uniform along the entire length of the manifold 10. The walls 12 and 14 are depicted as having substantially constant radii of curvature, with the concave wall 12 having a larger radius of curvature than the convex wall 14 to achieve the crescent shape shown in FIG. 1. The focus of the radius for the concave wall 12 can be understood as being offset from the focus of the radius of the convex wall 14 in a direction away from the manifold 10. However, it is foreseeable that the radii of the walls 12 and 14 could vary from that shown and still define an acceptable crescent shape for the manifold 10.

In FIG. 1, one extremity 23 of the passage 18 is truncated by a wall 26 that closes off one of the corresponding extremities 16 of the manifold 10, such that the heat exchange fluid is excluded from that region of the passage 18. The opposite extremity 24 of the passage 18 is also truncated, though by a wall 28 that is integral with the walls 12 and 14. The walls 26 and 28 promote the stiffness of the manifold 10. Though a manifold 10 with an internal passage 18 having truncated extremities 23 and 24 as shown in FIG. 1 is a preferred aspect of the invention, the walls 26 and 28 could be eliminated such that the internal passage 18 has a crescent-shaped cross-section that is substantially congruous with the outer cross-sectional shape of the manifold 10, i.e., differs in size only by the thickness of the walls 12 and 14.

Figure 2:
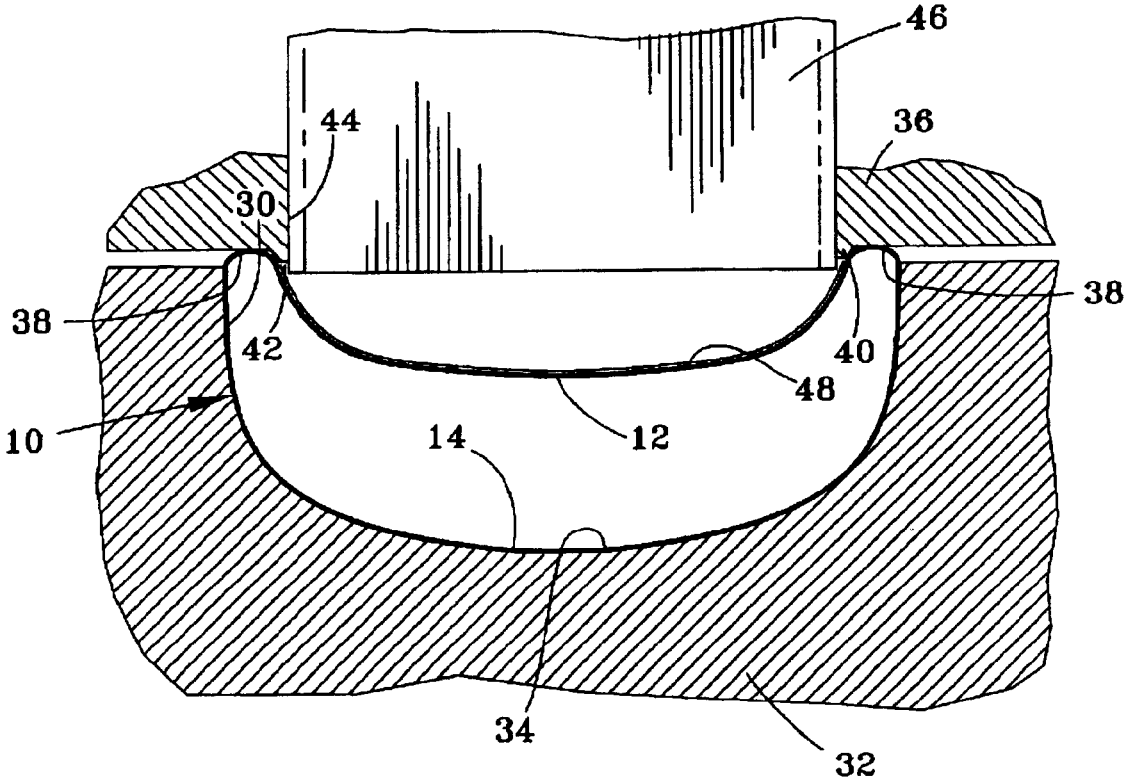
FIGS. 2 and 3 represent the manifold of FIG. 1 positioned within a die assembly immediately before and after a piercing operation performed on the manifold.
Figure 3:
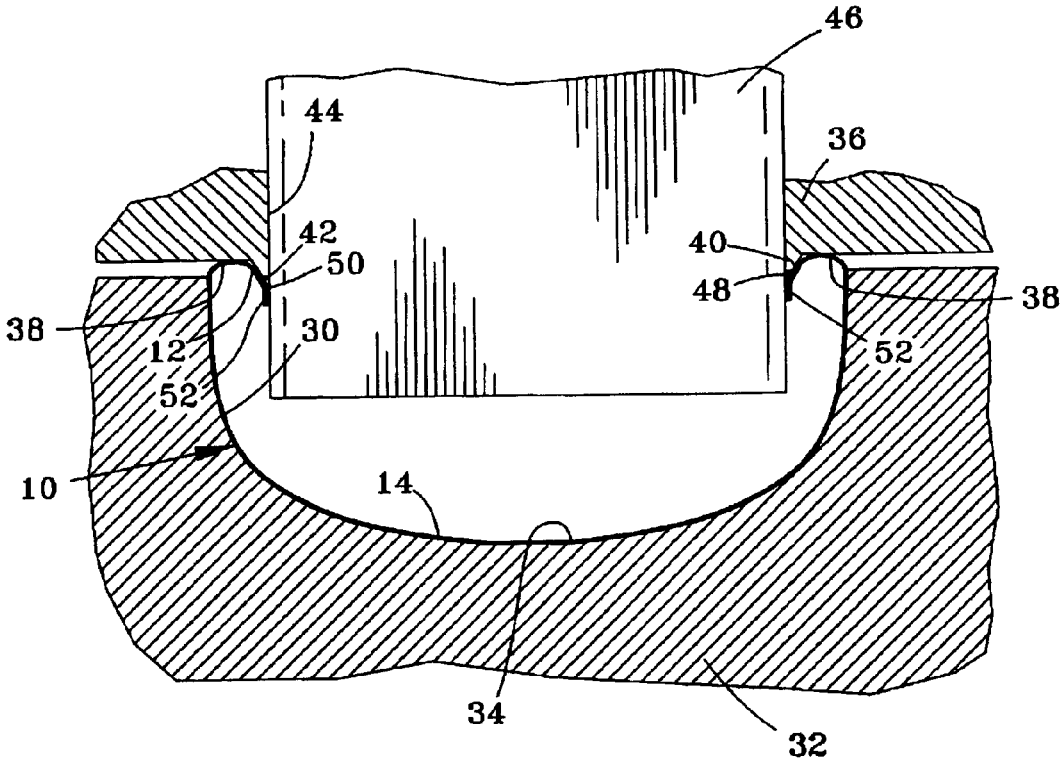

FIGS. 2 and 3 depict the manifold 10 of FIG. 1 placed in a die cavity 30 formed in a lower die 32, with the convex wall 14 of the manifold 10 contacting the die surface 34. The die surface 34 preferably conforms closely to the entire outer surface of the convex wall 14. An upper die 36 is shown in position on the lower die 32. The upper die 36 includes a pair of die surfaces 38 separated by a protrusion 40 that extends into a recess 42 defined by the concavity of the concave wall 12 of the manifold 10. In this manner, the die surfaces 38 are shown as contacting the extremities 16 of the manifold 10, thereby preventing the manifold 10 from rotating within the die cavity 30. The protrusion 40 of the upper die 36 includes a bore 44 in which a piercing tool 46 is received and, in FIG. 2, positioned for performing a piercing operation on the concave wall 12 of the manifold 10. While a single tool 46 is shown in the cross-sectional views of FIGS. 2 and 3, the upper die 36 can be equipped with any number of tools 46 to simultaneously perform any number of piercing operations along the length of the manifold 10 in accordance with this invention. The tool 46 is actuated by any suitable means capable of selectively actuating the tool 46 with a sufficient force to pierce the concave wall 12 of the manifold 10.

FIGS. 2 and 3 further show a filler material in the form of a shim 48 overlying the surface of the concave wall 12, such that the concave wall 12 effectively has a greater thickness than the convex wall 14. As known to those skilled in the art, the shim 48 can be employed to provide additional fill material to form a braze joint between the manifold 10 and tubes 20 in FIG. 4. Suitable materials for the shim 48 are those with a lower melting temperature than the manifold 10 and tubes 20. For example, if the manifold 10 and tubes 20 are formed of AA3003 aluminum alloy, a suitable material for the shim 48 is an aluminum-silicon eutectic brazing alloy, such as AA 4045, AA 4047 or AA 4343. In another embodiment, a channel (not shown) could be defined in the surface of the concave wall 12 for receiving filler wire for the same purpose. Yet another alternative would be to apply a suitable filler material as a coating on the concave wall 12. If the manifold 10 and tubes 20 are formed of aluminum alloys, such a coating may contain both the filler material and a suitable flux for displacing the oxides on the surfaces of manifold 10 and tubes 20 during brazing or soldering.

As shown in FIG. 3, and according to a preferred aspect of the invention, the tool 46 is able to pierce the concave wall 12 to form a tube port 50 without collapsing or otherwise excessively deforming the manifold 10, even though a mandrel or other tooling is not placed in the manifold passage 18 for support. Instead, the concave wall 12 undergoes moderate stretching in the immediate vicinity of the port 50. As a result, the piercing operation is significantly simplified, particularly if the tool 46 is configured to form the port 50 to have a collar 52, as shown in FIG. 3, for enhanced contact with one of the tubes 20 of the heat exchanger 22 in FIG. 4. While the ports 50 are shown as having oblong shapes (slots) that are complementary to the oblong or flat tubes 20 shown in FIG. 4, requiring that the tool 46 have a corresponding cross-sectional shape, the tool 46 could have any shape appropriate for a particular tube shape desired for a heat exchanger.

Following the piercing operation depicted in FIGS. 2 and 3, the heat exchanger 22 represented in FIG. 4 can be formed by inserting the tubes 20 in the tube ports 50 of a pair of manifolds 10 formed in the manner described above, positioning fins 21 between adjacent tubes 20, and then mechanically or metallurgically joining the tubes 20 to the manifolds 10 and the fins 21. The manifolds 10, with tube ports 50 having collars 52 as a result of the piercing operation described for this invention, are particularly well suited for being joined to the tubes 20 by brazing in a manner known in the art.

From the above, it can be seen that the configuration of the heat exchanger manifold 10 enables an uncomplicated piercing operation for forming one or more tube ports 50 on the manifold 10. A minimal number of processing steps are required to produce any number of finished ports 50, with all basic forming steps capable of being performed within a single die cavity 30. The finished ports 50 can be formed to include collars 52 that increases the amount of material available to engage and bond to heat exchanger tubes 20 assembled with the manifold 10, thereby promoting the joint strength between the manifold 10 and tubes 20.

FIG. 4 evidences that another benefit of the crescent-shaped manifold 10 is a reduction in bypass air—air that follows a short-circuit path through openings typically found between the fins and the near wall of a manifold in which the tubes are inserted, instead of through the fins where heat exchange occurs more efficiently. The extremities 16 of the manifold 10 protrude in front of any space between the fins 21 and the concave wall 12, thus promoting air flow through the fins 21 and inhibiting airflow between the fins 21 and the concave wall 12.

While the invention has been described in terms of a preferred embodiment, it is apparent that other forms could be adopted by one skilled in the art. For example, the processing steps could be modified, and materials and manifold configurations other than those noted above could be adopted in order to yield a heat exchanger suitable for a wide variety of applications. Accordingly, the scope of the invention is to be limited only by the following claims.

What is claimed is:

1. A heat exchanger having a pair of manifolds and tubes fluidically connected to the manifolds to allow fluid flow to and from the manifolds through the tubes, each of the manifolds having an internal passage that is substantially uniform along the entire length of the manifold, a plurality of tube ports in which the tubes are received for fluidic communication with the internal passage, and an outer cross-sectional shape that is substantially uniform along the entire length of the manifold in which the tubes are received, each of the manifolds comprising:

first and second walls that define the internal passage and the outer cross-sectional shape of the manifold, the first and second walls intersecting at oppositely-disposed extremities of the outer cross-sectional shape, the first wall having a concave outer surface and the second wall having a convex outer surface such that the outer cross-sectional shape of the manifold is crescent-shaped, the tube ports being disposed in the first wall.

2. A heat exchanger according to claim 1, wherein the internal passage has a crescent-shaped cross-section that is substantially congruous with the outer cross-sectional shape of the manifold.

3. A heat exchanger according to claim 1, wherein the internal passage is truncated at the oppositely-disposed extremities of the outer cross-sectional shape of the manifold so as to have a cross-sectional shape that differs from the outer cross-sectional shape of the manifold.

4. A heat exchanger according to claim 1, wherein the tube ports are pierced tube ports and portions of the first wall of each manifold defined collars that surround each of the tube ports and protrude into the internal passage of the manifold.

5. A heat exchanger according to claim 1, further comprising fins positioned between adjacent pairs of the tubes and a space between each of the fins and the first wall, the extremities of the manifold protruding over the spaces between the fins and the first wall so as to promote air flow through the fins.

6. A heat exchanger according to claim 1, further comprising a filler material on the concave outer surface of the first wall of each manifold, the filler material having a lower melting temperature than the first wall.

7. A heat exchanger manifold having an internal passage that is substantially uniform along the entire length of the manifold, an outer cross-sectional shape that is substantially uniform along the entire length of the manifold, and at least one tube port fluidically communicating with the internal passage, the manifold comprising first and second walls that define the internal passage and the outer cross-sectional shape of the manifold, the first wall having a concave outer surface and the second wall having a convex outer surface such that the outer cross-sectional shape of the manifold is crescent-shaped, the tube port being disposed in the first wall.

8. A heat exchanger manifold according to claim 7, wherein the internal passage has a crescent-shaped cross-section that is substantially congruous with the outer cross-sectional shape of the manifold.

9. A heat exchanger manifold according to claim 7, wherein the first and second walls intersect at oppositely-disposed extremities of the outer cross-sectional shape of the manifold, and the internal passage is truncated at the oppositely-disposed extremities of the outer cross-sectional shape of the manifold so as to have a cross-sectional shape that differs from the outer cross-sectional shape of the manifold.

10. A heat exchanger manifold according to claim 7, further comprising a tube received in the tube port.

11. A heat exchanger manifold according to claim 7 wherein the tube port is a pierced tube port and a portion of the first wall defines a collar that surrounds the tube port and protrudes into the internal passage.

12. A heat exchanger manifold according to claim 1, wherein the first wall has a greater thickness than the second wall.

13. A heat exchanger manifold according to claim 1, further comprising a filler material on the concave outer surface of the first wall, the filler material having a lower melting temperature than the first wall.

14. A heat exchanger manifold having an internal passage, an outer cross-sectional shape, and a plurality of tube ports fluidically communicating with the internal passage the manifold comprising first and second walls that define the internal passage and the outer cross-sectional shape of the manifold, the first wall having a concave outer surface and the second wall having a convex outer surface such that the outer cross-sectional shape of the manifold is crescent-shaped, the tube ports being disposed in the first wall, wherein the internal passage has a crescent-shaped cross-section that is substantially congruous with the outer cross-sectional shape of the manifold.

15. A heat exchanger manifold having an internal passage, an outer cross-sectional shape, and a plurality of tube ports fluidically communicating with the internal passage, the manifold comprising first and second walls that define the internal passage and the outer cross-sectional shape of the manifold, the first wall having a concave outer surface and the second wall having a convex outer surface such that the outer cross-sectional shape of the manifold is crescent-shaped, the tube ports being disposed in the first wall, wherein the first and second walls intersect at oppositely-disposed extremities of the outer cross-sectional shape of the manifold and the internal passage is truncated at the oppositely-disposed extremities of the outer cross-sectional shape of the manifold so as to have a cross-sectional shape that differs from the outer cross-sectional shape of the manifold.

16. A heat exchanger manifold having an internal passage, an outer cross-sectional shape, and a plurality of tube ports fluidically communicating with the internal passage, the manifold comprising first and second walls that define the internal passage and the outer cross-sectional shape of the manifold, the first wall having a concave outer surface and the second wall having a convex outer surface such that the outer cross-sectional shape of the manifold is crescent-shaped, the tube ports being disposed in the first wall, wherein the first wall has a greater thickness than the second wall.

17. A method of forming a heat exchanger manifold having an internal passage, an outer cross-sectional shape, and a plurality of tube ports fluidically communicating with the internal passage, the method comprising the steps of:

forming the manifold to have first and second walls that define the internal passage and the outer cross-sectional shape of the manifold, the first wall having a concave outer surface and the second wall having a convex outer surface such that the outer cross-sectional shape of the manifold is crescent-shaped; and then forming the tube ports in the first wall by piercing the first wall in a direction toward the inner passage.

18. A method according to claim 17, wherein the manifold is formed so that the internal passage has a crescent-shaped cross-section that is substantially congruous with the otter cross-sectional shape of the manifold, and so that the internal passage and the outer cross-sectional shape are substantially uniform along the entire length of the manifold.

19. A method according to claim 17, wherein the manifold is formed so that the first and second walls intersect at oppositely-disposed extremities of the outer cross-sectional shape of the manifold, and the internal passage is truncated at the oppositely-disposed extremities of the outer cross-sectional shape of the manifold so as to have a cross-sectional shape that differs from the outer cross-sectional shape of the manifold.

20. A method according to claim 17, further comprising the step of inserting tubes in the tube ports.

21. A method according to claim 17, wherein the step of forming the tube ports by piercing the first wall causes portions of the first wall to define collars, each of the collars surrounding a corresponding one of the tube ports and protruding into the internal passage.

22. A method according to claim 17, wherein the manifold is formed so that the first wall has a greater thickness than the second wall.

23. A method according to claim 17, further comprising the step of providing a source of a filler material on the concave outer surface of the first wall, the filler material having a lower melting temperature than the first wall.

24. A method according to claim 17, wherein the step of forming the tube ports in the first wall comprises:

positioning the manifold within a die cavity in a first die half, the die cavity conforming to the second wall of the manifold;

mating a second die half with the first die half, the second die half having first portions that abut the manifold to inhibit movement of the manifold within the die cavity, the second die half having a second portion that protrudes into a recess defined by the concave outer surface of the first wall, the second die half further having a piercing tool reciprocably received within a bore in the second die half; and then forcing the piercing tool through the first wall to form one of the tube ports.

25. A method of forming a heat exchanger having a pair of manifolds and tubes fluidically connected to the manifolds to allow fluid flow to and from the manifolds through the tubes, each of the manifolds having an internal passage, a plurality of tube ports in which the tubes are received for fluidic communication with the internal passage, and an outer cross-sectional shape that is substantially uniform along a length of the manifold in which the tubes are received, the method comprising the steps of:

forming each of the manifolds to have first and second walls that define the internal passage and the outer cross-sectional shape of the manifold, the first and second walls intersecting at oppositely-disposed extremities of the outer cross-sectional shape, the first wall having a concave outer surface and the second wall having a convex outer surface such that the outer cross-sectional shape of the manifold is crescent-shaped;

forming the tube ports in each of the manifolds, the tube ports of each manifold being formed by:

positioning the manifold within a die cavity in a first die half, the die cavity conforming to the second wall of the manifold;

mating a second die half with the first die half, the second die half having first portions that abut the oppositely-disposed extremities of the manifold to inhibit movement of the manifold within the die cavity, the second die half having a second portion between the first portions that protrudes into a recess defined by the concave outer surface of the first wall, the second die half further having piercing tools reciprocably received within bores in the second die half; and forcing the piercing tools through the first wall to form the tube ports and so that portions of the first wall surrounding the tube ports protrude into the internal passage;

inserting tubes in the tube ports; and then metallurgically joining the tubes to the manifolds.

26. A method according to claim 25, wherein each manifold is formed so that the internal passage has a crescent-shaped cross-section that is substantially congruous with the outer cross-sectional shape of the manifold.

27. A method according to claim 25, wherein the internal passage of each manifold is truncated at the oppositely-disposed extremities of the outer cross-sectional shape of the manifold so as to have a cross-sectional shape that differs from the outer cross-sectional shape of the manifold.

28. A method according to claim 25, wherein each manifold is formed so that the first wall thereof has a greater thickness than the second wall thereof.

29. A method according to claim 25, further comprising the step of providing a source of a filler material on the concave outer surface of the first wall of each manifold, the filler material having a lower melting temperature than the first wall.

* * * * *